United States Patent [19]

Christopher

[11] Patent Number: 4,894,868

[45] Date of Patent: Jan. 23, 1990

[54] SHOULDER PAD HARNESS

[76] Inventor: Pamela E. Christopher, 5820 McCommas, No. 2, Dallas, Tex. 75206

[21] Appl. No.: 281,674

[22] Filed: Dec. 9, 1988

[51] Int. Cl.[4] ..... A41D 27/26

[52] U.S. Cl. ..... 2/268; 450/86

[58] Field of Search ..... 2/268, 104; 450/36, 450/86, 87, 88

[56] References Cited

U.S. PATENT DOCUMENTS

| | | | |
|---|---|---|---|
| 2,483,809 | 10/1949 | Clark et al. | 2/268 |
| 2,497,808 | 2/1950 | Zacks | 2/268 |
| 2,534,513 | 12/1950 | Gerry | 2/268 |
| 3,203,424 | 8/1965 | Garutso | 450/68 |
| 4,552,144 | 11/1985 | Seivaggi | 450/86 |
| 4,612,935 | 9/1986 | Greifer | 2/268 X |

*Primary Examiner*—Werner H. Schroeder
*Assistant Examiner*—Jeanette E. Chapman
*Attorney, Agent, or Firm*—David H. Judson

[57] ABSTRACT

A shoulder pad harness for securely and comfortably supporting a pair of shoulder pads on a wearer's shoulders without a bra or other fasteners is described. Preferably, the shoulder pad harness comprises an adjustable chest strap adapted to be supported longitudinally about a wearer's chest, the adjustable chest strap including a base portion, first and second ends attached to the base, and a clasp for securing the first and second ends of the adjustable chest strap. First and second adjustable shoulder straps are secured and supported generally transversely to the adjustable chest strap, and first and second shoulder pads are secured to the first and second shoulder straps, respectively. In the preferred embodiment, the shoulder pads are made of foam, lined with cotton and covered with lace. To facilitate the wearer's placement of the harness without having to search for a right or left side, the harness includes a pair of tabs sewn adjacent the first and second ends of the adjustable chest strap.

9 Claims, 1 Drawing Sheet

SHOULDER PAD HARNESS

TECHNICAL FIELD

The present invention relates generally to clothing accessories and more particularly to an apparatus for rigidly supporting shoulder pads under a garment.

BACKGROUND OF THE INVENTION

Over the last several years, many women have begun to wear soft shoulder pads under a dress or sweater to provide a more fashionable appearance to their clothing. Currently, there are basically three (3) types of shoulder pads on the market: the sponge "stay-on", a pad which is secured to a bra with Velcro fasteners or the like, and a bra with a built-in shoulder pad. The sponge "stay-on" pad is highly undesirable because it often falls out-of-place with certain ordinary movements, with loose fitting garments or with garmets made of woven fabrics. The second type of pad, those with Velcro fasteners, are difficult to position correctly on the bra strap. They also have a tendency to fray the bra strap, thereby ruining expensive lingerie. The third type, the shoulder pad built into a bra, has also found little commercial acceptance because it is expensive to manufacture and cumbersome to use. It is also very difficult to get one style of bra that will fit and satisfy all wearers. This style has a further disadvantage in that the customer can only wear the should pads when wearing that particular bra.

It would therefore be desirable to provide an improved apparatus for securely and comfortably supporting shoulder pads which overcomes these and other problems associated with the prior art.

BRIEF SUMMARY OF THE INVENTION

It is an object of the present invention to provide an apparatus for supporting a pair of shoulder pads in a secure and comfortable manner for the user.

It is yet another object of the present invention to provide a shoulder pad harness which rigidly supports a pair of shoulder pads without the use of a bra or other fastener.

It is still another object of the invention to provide a shoulder pad harness which is easy to use and which supports a pair of lace shoulder pads.

These and other objects of the invention are provided in a shoulder pad harness having an adjustable chest strap, first and second adjustable shoulder straps supported generally transversely to the chest strap, and first and second shoulder pads supported on the first and second shoulder straps, respectively. Preferably, the shoulder pads are made of foam, lined in cotton knit to prevent chafing and then covered with lace. The adjustable chest and shoulder straps eliminate the need for different sizes. The adjustable chest strap also includes a pair of tabs sewn thereto for facilitating the wearer's use of the shoulder pad harness.

The foregoing has outlined some of the more pertinent objects of the present invention. These objects should be construed to be merely illustrative of some of the more prominent features and applications of the invention. Many other beneficial results can be attained by applying the disclosed invention in a different manner of modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

Similar reference characters refer to similar parts throughout the several views of the drawings.

DETAILED DESCRIPTION

Figure 2:
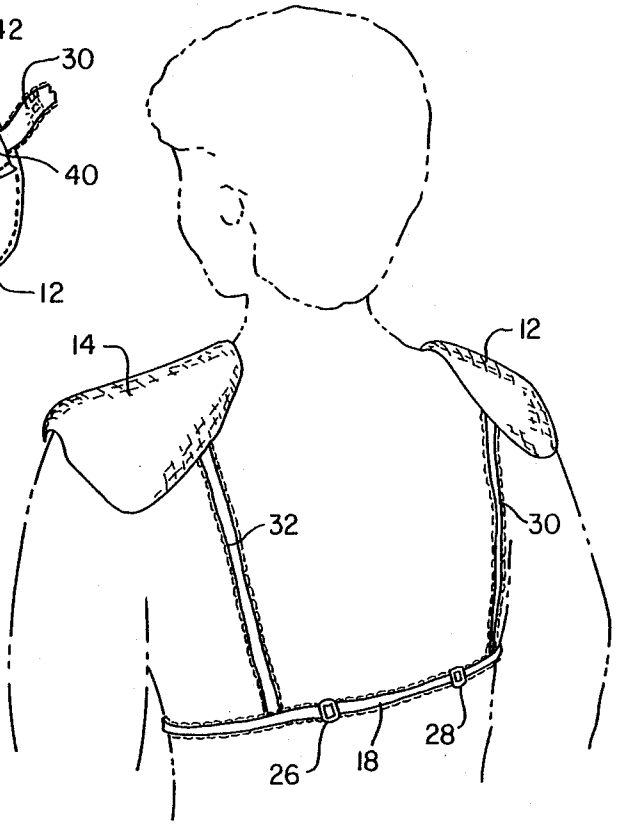
FIG. 2 is a perspective view of the rear portion of the shoulder pad harness supported on the user.
Figure 1:
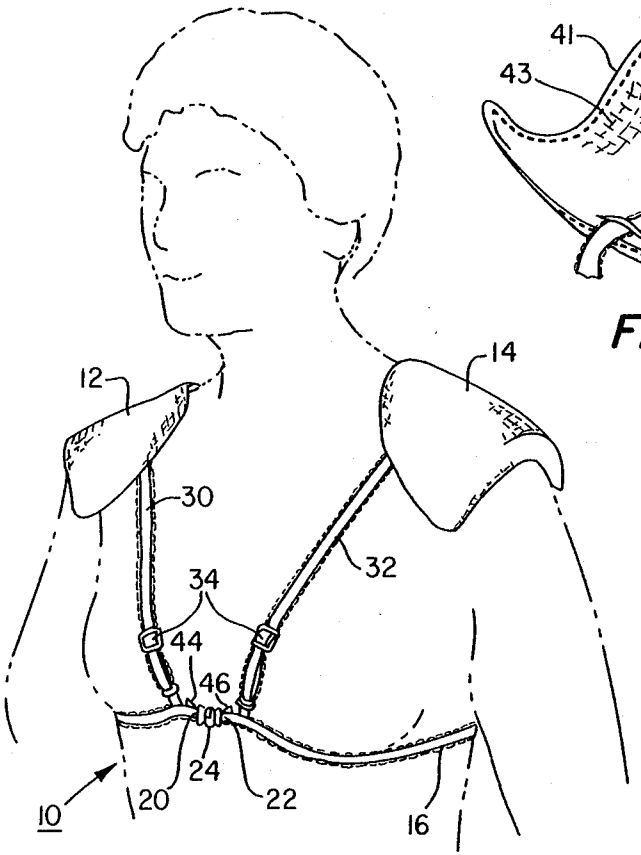
FIG. 1 is a perspective view of a front portion of the shoulder pad harness of the present invention as it is supported on a user.

Referring now to FIG. 1, a shoulder pad harness 10 for use in securely and comfortably supporting a pair of shoulder pads 12 and 14 on a wearer's shoulders without a bra or other fasteners is shown. Preferably, the shoulder pad harness 10 comprises an adjustable chest strap 16 adapted to be supported longitudinally about a wearer's chest at approximately the chest midline. The chest strap may also be supported below the midline if desired. Referring simultaneously to FIGS. 1 and 2, in the preferred embodiment of the invention the adjustable chest strap 16 includes a base portion 18, first and second ends 20 and 22 attached to the base portion 18, and a clasp 24 for securing the first and second ends 20 and 22. The clasp 24 is preferably located at the front and center portion of the harness as viewed in FIG. 1 and can be any one of several well known fasteners typically used in bras or the like. The adjustable chest strap also includes a ring 26 located along the base portion 18 in the rear of the harness as seen in FIG. 2. The strap loops and slides through the ring 26, thereby allowing movement of an adjustment clasp 28 for enabling the wearer to adjust the length of the chest strap.

Figure 3:
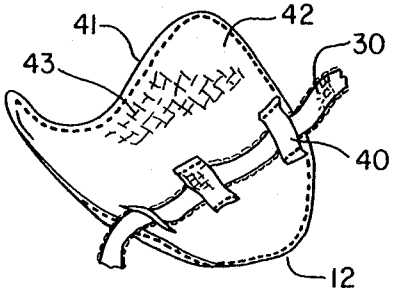
FIG. 3 is a detailed view of the interior portion of one of the shoulder pads of FIG. 1 showing how the pad is supported on the shoulder strap according to the teachings of this invention.

The shoulder pad harness also includes first and second adjustable shoulder straps 30 and 32 secured and supported generally transversely to the adjustable chest strap 16 substantially as shown in FIGS. 1 and 2. Each of the shoulder straps 30 and 32 include a standard type of adjustment clasp 34 preferably located at the front of the harness to enable the wearer to adjust how tight the pads are secured. Each adjustment clasp 34 has a plastic ring 35 associated therewith. The first and second shoulder pads 12 and 14 are secured to the first and second shoulder straps 30 and 32, respectively. In the preferred embodiment, and as best seen in FIG. 3, each shoulder pad includes a plurality of support bands 40 sewn to an interior portion 42 thereof through which the shoulder strap passes. Alternatively, the pad may be sewn directly to the shoulder strap or fastened thereto by a Velcro fastener or the like. The pads are preferably made of foam, lined with cotton 41 and covered with lace 43.

Referring back to FIG. 1, to facilitate the wearer's placement of the harness without having to search for a right or left side, the harness includes a pair of tabs 44 and 46 sewn adjacent to an interior of the first and second ends 20 and 22 of the adjustable chest strap 16. The tabs 44 and 46 are preferably colored to make them easy to locate. Alternatively, the tabs 44 and 46 are incorporated into or sewn adjacent the plastic loops 35 located at a front-end position 37 of the shoulder strap as shown in phantom in FIG. 1. In use, the wearer simply holds her thumbs on the colored tabs as the harness is held in front of her with clasp 24 unfastened. The wearer then brings both hands behind her back. The wearer then puts her thumbs plus both tabs in one hand and back on the colored tabs and brings her hands back in front of her. The clasp 24 is in front as shown in FIG. 1. The wearer then pulls the pads onto her shoulders and adjusts the chest and shoulder straps as needed for comfort. Once the straps are adjusted, the harness will be ready to wear.

The disclosed shoulder pad harness is advantageous because it is designed to put on like a bra, yet it is independent of and can be worn over any bra of the wearer's choice. The fully adjustable chest and shoulder straps keep the pads secure, insure a comfortable fit, and are designed to eliminate the need for different sizes. The shoulder pads, unlike conventional fiberfill pads, are made of foam, lined in cotton to prevent chafing, and then covered with lace to provide a pleasing aesthetic appearance. To provide maximum customer acceptance, preferably the harness and pads are packaged in a separate laundry bag which can be independently used to support the harness during washing and drying.

It should be appreciated by those skilled in the art that the specific embodiments disclosed above may be readily utilized as a basis for modifying or designed other structures for carrying out the same purposes of the present invention. It should also be realized by those skilled in the art that such equivalent constructions do not depart from the spirit and scope of the invention as set forth in the appended claims.

What is claimed is:

1. A shoulder pad harness adapted to be used exclusively of a brassiere, comprising:

an adjustable narrow band extending around a torso of the wearer below but not covering the wearer's breasts;

first and second adjustable shoulder straps each having first and second ends and an intermediate portion, the first end of each shoulder strap being secured to a front portion of the narrow band with the second end of each shoulder strap being secured to a back portion of the narrow band such that in use the intermediate portion of each shoulder strap is supported generally transversely to the adjustable narrow band; and first and second shoulder pads secured to the first and second shoulder straps, respectively, with each shoulder pad secured to the intermediate portion of one of the shoulder straps and adapted to be securely and comfortably supported on the wearer's shoulders independent of the wearer's brassiere.

2. The shoulder pad harness as described in claim 1 wherein the shoulder pads comprise a foam material lined in cotton knit and covered with lace.

3. The shoulder pad harness as described in claim 1 wherein the adjustable narrow band further includes a base portion, first and second ends attached to the base, and a clasp for securing the first and second ends of the adjustable narrow band.

4. The shoulder pad harness as described in claim 3 wherein the adjustable narrow band also includes a pair of tabs sewn adjacent the first and second ends to facilitate the wearer's placement of the shoulder pad harness during use.

5. The shoulder pad harness as described in claim 4 wherein the tabs are colored.

6. The shoulder pad narness as described in claim 1 wherein the base portion of the adjustable includes at least one adjustment clasp for adjusting the length of the narrow band

7. A shoulder pad harness adapted to be used exclusively of a brassiere, comprising:

an adjustable narrow band extending around a torso of the wearer below but not covering the wearer's breasts, the narrow band including a base portion, first and second ends attached to the base, and a clasp for securing the first and second ends of the adjustable narrow band;

first and second adjustable shoulder straps each having first and second ends and an intermediate portion, the first end of each shoulder strap being secured to a front portion of the narrow band with the second end of each shoulder strap being secured to a back portion of the narrow band such that in use the intermediate portion of each shoulder strap is supported generally transversely to the adjustable narrow band;

first and second cotton shoulder pads secured to the first and second shoulder straps, respectively, with each shoulder pad secured to the intermediate portion of and adapted to be securely and comfortably supported on the wearer's shoulder independent of the wearer's brassiere; and a pair of tabs sewn adjacent the first and second ends of the adjustable narrow band to facilitate the wearer's placement of the shoulder pad harness during use.

8. A shoulder pad harness adapted to be used exclusively of a brassiere, comprising:

an adjustable narrow band extending around a torso of the wearer below but not covering the wearer's breasts, the narrow band including a base portion, first and second ends attached to the base, and a clasp for securing the first and second ends of the adjustable narrow band;

first and second adjustable shoulder straps each having first and second ends and an intermediate portion, the first end of each shoulder strap being secured to a front portion of the narrow band with the second end of each shoulder strap being secured to a back portion of the narrow band such that in use the intermediate portion of each shoulder strap is supported generally transversely to the adjustable narrow band;

first and second cotton shoulder pads secured to the first and second shoulder straps, respectively, with each shoulder pad secured to the intermediate portion of and adapted to be securely and comfortably supported on the wearer's shoulderss independent of the wearer's brassiere; and a pair of tabs attached adjacent a front end of each of the shoulder straps to facilitate the wearer's placement of the shoulder pad harness during use.

9. A shoulder pad harness adapted to be used exclusively of a brassiere, comprising:

an adjustable narrow band extending around a torso of the wearer below but not covering the wearer's breasts, the adjustable narrow band including a base portion, first and second ends attached to the base, a clasp for securing the first and second ends of the adjustable narrow band, and a pair of tabs sewn adjacent the first and second ends to facilitate the wearer's placement of the shoulder pad harness during use;

first and second adjustable shoulder straps each having first and second ends and an intermediate portion, the first end of each shoulder strap being secured to a front portion of the narrow band with the second end of each shoulder strap being secured to a back portion of the narrow band such that in use the intermediate portion of each shoulder strap is supported generally transversely to the adjustable narrow band;

first and second shoulder pads each comprising a foam material lined in cotton knit and covered with lace, the first and second shoulder pads secured to the first and second shoulder straps, respectively, with each shoulder pad secured to the intermediate portion of and adapted to be securely and comfortably supported on the wearer's shoulders independent of the wearer's brassiere.

* * * * *